US007723929B2

(12) United States Patent
Orr

(10) Patent No.: US 7,723,929 B2
(45) Date of Patent: May 25, 2010

(54) VARIABLE INDUCTIVE POWER SUPPLY ARRANGEMENT FOR COLD CATHODE FLUORESCENT LAMPS

(75) Inventor: Raymond K. Orr, Kanata (CA)

(73) Assignee: Power Integrations, Inc., San Jose, CA (US)

( * ) Notice: Subject to any disclaimer, the term of this patent is extended or adjusted under 35 U.S.C. 154(b) by 0 days.

(21) Appl. No.: 11/945,699

(22) Filed: Nov. 27, 2007

(65) Prior Publication Data

US 2008/0129217 A1 Jun. 5, 2008

Related U.S. Application Data

(60) Provisional application No. 60/867,296, filed on Nov. 27, 2006.

(51) Int. Cl.
*G05F 1/00* (2006.01)

(52) U.S. Cl. ..... 315/308; 315/291; 315/312; 315/247; 315/274

(58) Field of Classification Search ..... 315/243, 315/242, 241 R, 224, 258, 259, 284, 247, 315/246, 209 R, 219, 223, 213, 291, 297, 315/307–311, 278, 279, 274
See application file for complete search history.

(56) References Cited

U.S. PATENT DOCUMENTS

| | | | | |
|---|---|---|---|---|
| 4,032,817 | A * | 6/1977 | Richmond | 315/149 |
| 4,988,920 | A * | 1/1991 | Hoeksma | 315/101 |
| 5,233,273 | A * | 8/1993 | Waki et al. | 315/224 |
| 5,410,466 | A * | 4/1995 | Maehara | 363/98 |
| 5,459,377 | A * | 10/1995 | Zheng | 315/289 |
| 6,137,234 | A * | 10/2000 | Willaert et al. | 315/209 R |
| 6,437,518 | B1 * | 8/2002 | Ito et al. | 315/290 |
| 7,235,931 | B2 * | 6/2007 | Matsushima et al. | 315/240 |
| 2005/0184684 | A1 * | 8/2005 | Matsushima et al. | 315/312 |
| 2007/0085486 | A1 * | 4/2007 | Okamoto et al. | 315/209 R |

* cited by examiner

*Primary Examiner*—Tuyet Vo
(74) *Attorney, Agent, or Firm*—Marshall, Gerstein & Borun LLP

(57) ABSTRACT

A plurality of cold cathode fluorescent lamps (CCFLs) for a backlight of a display device are connected, each in series with a respective variable inductance, in parallel to an AC supply from a power converter. Each variable inductor comprises a first inductor in series with the CCFL, a second inductor inductively coupled to the first inductor, and an AC switch for selectively shorting the second inductor. A capacitor in parallel with the first inductor forms a resonant circuit tuned to the AC supply frequency when the switch is open. Each switch is opened and closed with a controlled duty cycle to provide individual control of an average current of each CCFL.

17 Claims, 3 Drawing Sheets

VARIABLE INDUCTIVE POWER SUPPLY ARRANGEMENT FOR COLD CATHODE FLUORESCENT LAMPS

This application claims the benefit of U.S. Provisional Application No. 60/867,296 filed Nov. 27, 2006, the entire contents and disclosure of which are hereby incorporated herein by reference.

This invention relates to a power supply arrangement for cold cathode fluorescent lamps (CCFLs).

BACKGROUND

It is well known to provide a liquid crystal display (LCD) device with a CCFL backlight. In order to provide a sufficient and uniform brightness over a large display area, such as may be necessary for example for a television display, the backlight typically comprises a plurality of CCFLs. For example, an LCD display device may comprise a plurality of CCFLs arranged horizontally parallel to and one above another behind an LCD so as to extend over substantially all of the area of the LCD, with reflectors behind the CCFLs, and a diffusion screen, polarizing filter, and colour filters between the CCFLs and the LCD. In such an arrangement there may be a substantial number of CCFLs, for example from 16 to 36 for a large display area.

A CCFL, like other discharge tubes, has a breakover or ignition voltage which must be exceeded in order to establish a discharge. A voltage-current characteristic of the CCFL is such that, after establishment of a discharge, voltage falls to a valley voltage with increasing current, and then increases with increasing current in a normal operating region in which the voltage may be appreciably less than the breakover voltage. For example, the breakover voltage of a CCFL supplied with a substantially sinusoidal AC voltage may be of the order of 1500 volts, and the operating voltage may be of the order of 700 to 800 volts, with an operating current, at this operating voltage, of the order of 5 to 10 mA. A slope of the voltage-current characteristic in the operating region is referred to as the impedance of the plasma or of the CCFL.

A result of this characteristic is that a plurality of CCFLs can not simply be connected together directly in parallel to a single power supply, because initiation of the discharge in one of the CCFLs would prevent a discharge being established in other CCFLs. A ballast resistor can be connected in series with each of the CCFLs to facilitate such a parallel connection to a single power supply, but this would result in an unacceptable power loss in the ballast resistors. Alternatively, a ballast capacitor can be connected in series with each of the CCFLs to facilitate such a parallel connection to a single power supply.

With either ballast resistors or capacitors, inevitable differences between the characteristics of the individual CCFLs result in different backlight levels over the area of the display. Such arrangements do not provide any individual control of the CCFLs, as may also be desired for example to provide different brightnesses in different areas of the display device.

It is known to provide an individual inverter (DC to AC power converter) for supplying AC power to each CCFL of a display device, and to provide a single DC to DC converter whose output voltage is supplied to all of the inverters. For example this DC to DC converter may have an output voltage in a range from 12 to 24 volts, and may also serve to supply DC power to other parts of apparatus, for example a television receiver, including the display device. A respective current sensing resistor can be connected in series with each CCFL to provide a feedback signal to the respective inverter, thereby to control the output of the inverter so that all of the CCFLs provide substantially the same backlight level. However, this involves the disadvantage that the display device requires as many separate inverters as it has CCFLs, which can be a significant number especially for large displays.

In such a known power supply arrangement, for example the single DC to DC converter may be supplied with power from an AC supply via a PFC (power factor correction) circuit which provides a DC output voltage of the order of, for example, 400 volts. It can be appreciated that the inverters can be supplied from the output of the PFC circuit instead of from the output of a DC to DC converter, but this does not avoid the disadvantage of requiring as many inverters as the display device has CCFLs.

Consequently, there is a need for an improved power supply arrangement for CCFLs, in particular for backlights for LCD display devices.

SUMMARY OF THE INVENTION

According to one aspect, this invention provides a power supply arrangement comprising: an AC (alternating current) supply line; a variable inductance for connection in series with a cold cathode fluorescent lamp (CCFL) for supplying power from the AC supply line to the lamp; and a controller for controlling the variable inductance to control current of the lamp.

The power supply arrangement can include a switch mode power converter for supplying power to the AC supply line.

The variable inductance preferably comprises a first inductor for connection in series with the CCFL, a second inductor inductively coupled to the first inductor, and an AC switch coupled to the second inductor and controlled by the controller. Advantageously the second inductor and the AC switch are electrically isolated from the first inductor. A capacitor can be coupled in parallel with the first inductor to form a resonant circuit which in one state of the AC switch has a resonant frequency at approximately a frequency of the AC on the AC supply line.

The power supply arrangement can include a current sensing element for providing to the controller a signal representing current of the CCFL.

The switch mode power converter can include a transformer having a secondary winding coupled to the AC supply line, the power supply arrangement including a capacitor coupled in parallel with the secondary winding to form a resonant circuit with a resonant frequency near but displaced from a frequency of the AC on the AC supply line. The transformer can have at least one other secondary winding providing another output of the switch mode power converter.

For supplying power from the AC supply line to each of a plurality of CCFLs, the power supply arrangement can comprise a plurality of variable inductances each for connection in series with a respective one of the CCFLs for supplying power thereto from the AC supply line, the controller being arranged to control each variable inductance to control current of the respective CCFL. In this case preferably each variable inductance can be as recited above, and the power supply arrangement can include, for each of the plurality of CCFLs, a current sensing element for providing to the controller a signal representing current of the respective CCFL.

Another aspect of the invention provides a power supply arrangement comprising: an AC (alternating current) supply line; a plurality of variable inductances each for connection in series with a respective one of a plurality of cold cathode fluorescent lamps (CCFLs) for supplying power from the AC supply line to the lamps; and a controller for controlling the variable inductances to control currents of the lamps.

The invention also provides a backlight for a display device, the backlight comprising a plurality of CCFLs and a power supply arrangement as recited above, each of the plurality of CCFLs being connected in series with a respective one of the variable inductances.

A further aspect of the invention provides a method of providing power to a plurality of cold cathode fluorescent lamps (CCFLs), comprising the steps of: producing an AC (alternating current) supply using a switch mode power converter; coupling the AC supply to each of the CCFLs via a respective one of a plurality of variable inductances; and controlling each of the variable inductances to control current of the respective CCFL.

Preferably, when each variable inductance comprises a first inductor coupled in series with the respective CCFL, a second inductor inductively coupled to and electrically isolated from the first inductor, and an AC switch coupled to the second inductor, the step of controlling each of the variable inductances comprises opening and closing the respective AC switch with a controlled duty cycle. The method preferably further includes the step of sensing current of the plurality of CCFLs, the duty cycle of each AC switch being controlled in dependence upon the sensed current.

BRIEF DESCRIPTION OF THE DRAWINGS

The invention will be further understood from the following description by way of example with reference to the accompanying drawings, in which the same references are used in different figures to denote similar parts and in which.

DETAILED DESCRIPTION

Figure 1:
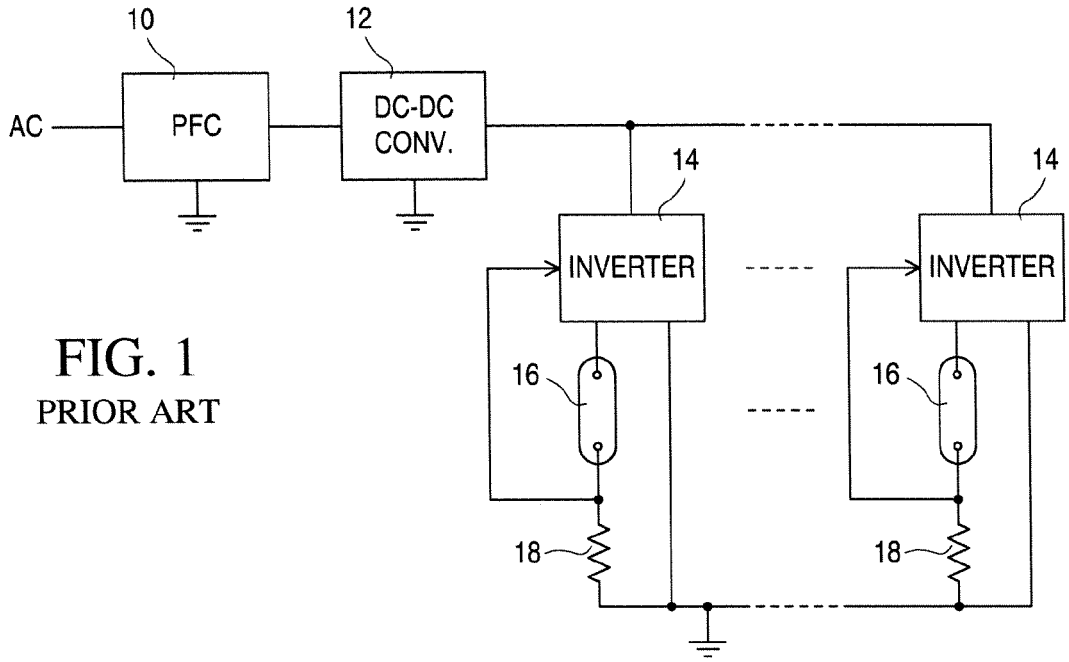
FIG. 1 PRIOR ART
FIG. 1 illustrates a known power supply arrangement for a plurality of CCFLs.

Referring to the drawings, a known power supply arrangement for a plurality of CCFLs is illustrated in FIG. 1. As shown in FIG. 1, AC power is supplied to a power factor correction (PFC) circuit 10, an output of which is supplied to a DC to DC converter 12. An output of the DC to DC converter 12, which may also be used to power other electronic circuits not shown, is connected to the inputs of a plurality of N inverters 14, of which only two are shown. The PFC circuit 10 produces at its output a DC voltage for example of the order of 380 volts, and the DC to DC converter 12 produces at its output a DC voltage for example of the order of 12 or 24 volts.

Each inverter 14 produces an AC output voltage which is supplied to a respective one of N CCFLs 16, each connected in series with a respective current sensing resistor 18. A voltage dropped across each current sensing resistor 18 is fed back as a control signal to the respective inverter 14, to maintain a desired current through the respective CCFL 16. Accordingly, each inverter 14 can provide an AC output voltage that is sufficient initially to establish a discharge in the respective CCFL and thereafter to maintain current through the respective CCFL at a desired level, for example in a range of 5 to 10 mA.

As discussed above, such a known power supply arrangement requires as many inverters 14 as there are CCFLs 16. This requirement can be avoided by another known power supply arrangement for example as shown in FIG. 2.

In the power supply arrangement of FIG. 2 AC power is again supplied to a power factor correction (PFC) circuit 10, an output of which is supplied to a switch mode power converter 20 which provides an AC output on an AC supply line 22. The AC output is supplied to each of a plurality of CCFLs 16 via a respective one of a plurality of ballast capacitors 24, with a return path via a single sensing resistor 18. A voltage dropped across the resistor 18 represents a total current of all the CCFLs and is supplied to the power converter 20 as a feedback signal to control the AC output voltage of the power converter.

Figure 2:
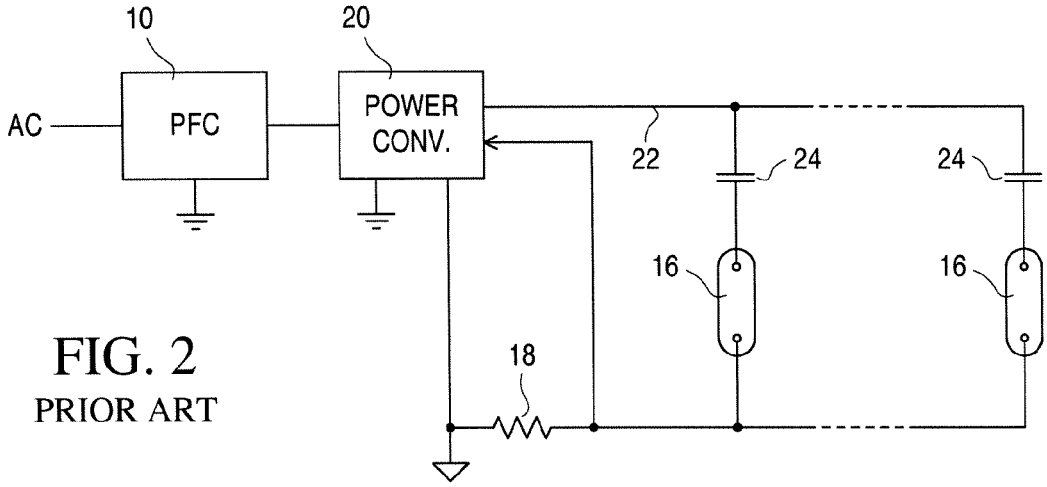
FIG. 2 PRIOR ART
FIG. 2 illustrates another known power supply arrangement for a plurality of CCFLs.

The power supply arrangement of FIG. 2 avoids the need for as many inverters as there are CCFLs as in the arrangement of FIG. 1, but does not provide any individual control of the CCFLs 16. Consequently, differences between characteristics of the individual CCFLs 16, and between characteristics of the individual ballast capacitors 24, result in variations of brightness of the CCFLs 16, and hence different backlight levels over the area of a display device including the CCFLs.

Figure 3:
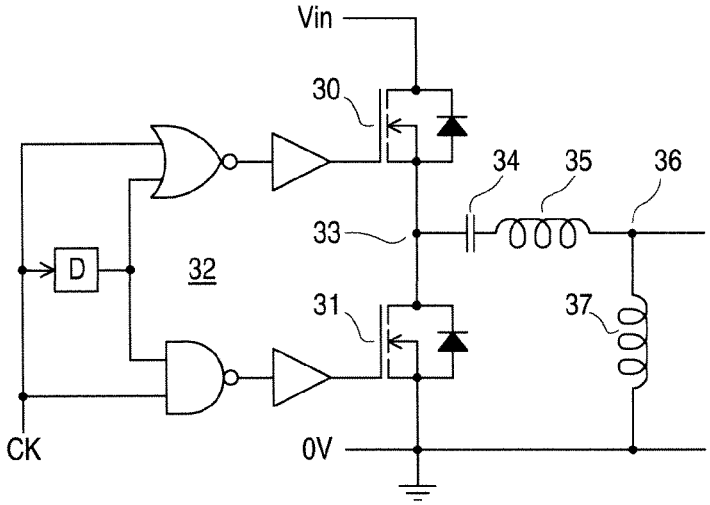
FIG. 3 PRIOR ART
FIG. 3 illustrates a known form of power converter.

The power converter 20 can have any desired form, but for example can be a resonant converter having an LLC (inductor-inductor-capacitor) topology as described further below, in order to facilitate zero voltage switching in known manner to reduce power losses and interference. FIG. 3 illustrates by way of example a known form of power converter having an LLC topology.

As shown in FIG. 3, a switch mode power converter having an LLC topology comprises a half-bridge arrangement of two MOSFET switches 30 and 31 which are switched on and off in a complementary manner, via a gate drive circuit 32 including a delay element (D) providing a switching dead time, under the control of a control signal CK, to connect a junction 33 alternately to an input voltage Vin, for example constituted by the output voltage of a PFC circuit 10 as described above, and ground or zero volts. The junction 33 is coupled via a series connected capacitor 34 and inductor 35 to an AC output 36 of the power converter 20. The output 36 is connected to ground via an inductor 37. The inductors 35 and 37, and the capacitor 34, give rise to the 'LLC' designation of the power converter.

Figure 4:
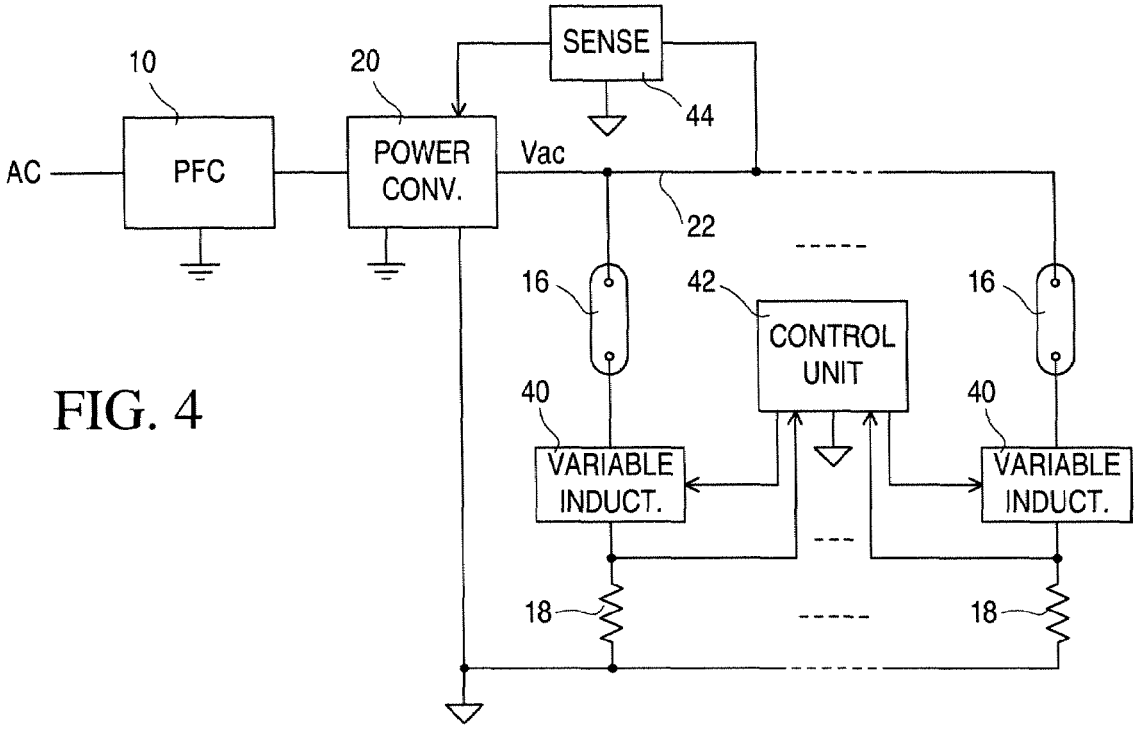
FIG. 4 illustrates a power supply arrangement for a plurality of CCFLs in accordance with an embodiment of this invention.

A power supply arrangement for a plurality of CCFLs, in accordance with an embodiment of this invention, is illustrated in FIG. 4. As in the power supply arrangement of FIG. 2, as shown in FIG. 4 AC power is supplied to a power factor correction (PFC) circuit 10, an output of which is supplied to a switch mode power converter 20 which provides an AC output to the AC supply line 22. This AC output is supplied to each of the plurality of N CCFLs 16 in series with a respective one of N variable inductance units 40 and a respective one of N current sensors in this case constituted by current sensing resistors 18. For simplicity and clarity FIG. 4 shows only two of the CCFLs 16, current sensing resistors 18, and variable inductance units 40. The power supply arrangement of FIG. 4 also includes a controller or control unit 42 which, for each of the N CCFLs 16, is supplied with a voltage dropped across the respective current sensing resistor 18 and controls the respective variable inductance unit 22 to maintain a desired average current through the respective CCFL 16.

In the power supply arrangement of FIG. 4, the AC output voltage Vac of the power converter 20 on the AC supply line 22 is monitored by a voltage sensor 44 which provides feedback control to the power converter 20 to maintain a desired value of this AC supply voltage Vac. This desired voltage value can be varied for example to vary a brightness level of all of the CCFLs 16.

Thus instead of the N inverters 14 required in the power supply arrangement of FIG. 1, the power supply arrangement of FIG. 4 includes only one power converter 20 and a plurality of N variable inductance units 40, as well as the control unit 42 for controlling the variable inductance units 40. However, in contrast to the power supply arrangement of FIG. 2, it enables the currents of the CCFLs to be individually and independently sensed and controlled, so that the brightness of individual lamps can be adjusted accordingly. The control unit 42 can be conveniently provided in an ASIC (application specific integrated circuit), and each of the variable inductance units 40 can be provided for example as described below, so that these can be provided at relatively low cost especially for large values of N.

In an embodiment of the invention, each of the variable inductance units 40 conveniently can be switched between two different states, as further described below by way of example. Such switching can occur at a relatively low frequency compared to a switching frequency of the power converter 20; for example each state for each of the units 40 can correspond to a multiple of a period of the switching states of the power converter 20. The switching frequency of the power converter 20 can be phase controlled and locked to that of the PFC circuit 10 to facilitate reduced interference. As shown by different ground symbols for the input and output sides of the power converter 20, this can optionally provide isolation between its input and output.

Figure 5:
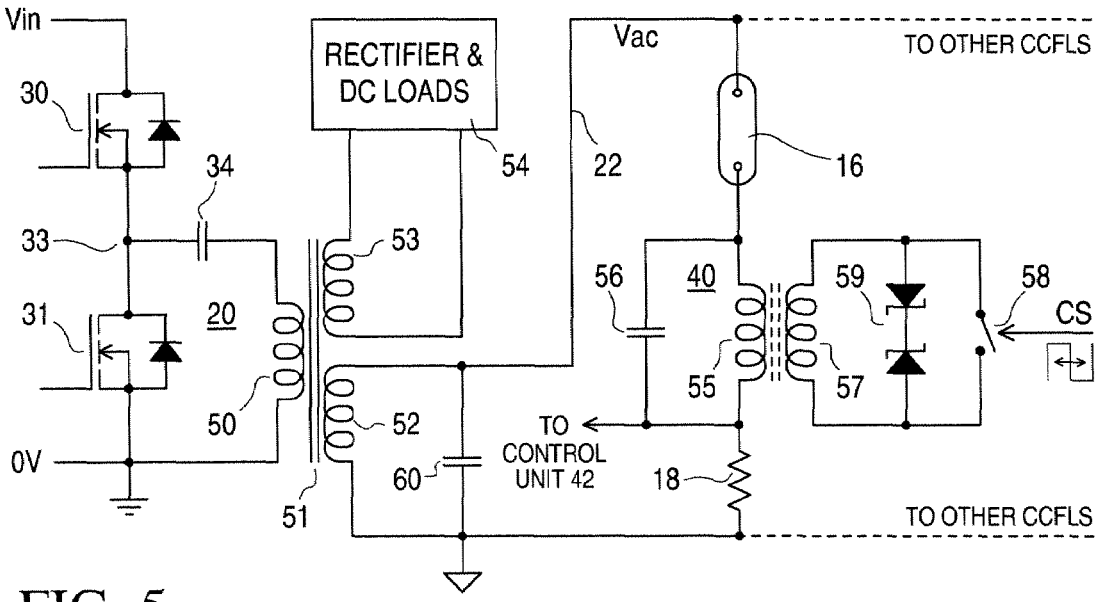
FIG. 5 illustrates parts of a power supply arrangement for one or more CCFLs in accordance with another embodiment of this invention.

Parts of a power supply arrangement, in accordance with another embodiment of this invention, for example using an LLC power converter topology, are shown in greater detail in FIG. 5, in which only one CCFL 16, with its variable inductance unit 40 and sensing resistor 18, is shown. Others can optionally be provided and connected in a similar manner as indicated by dashed lines.

As shown at the left side of FIG. 5, the power converter 20 comprises MOSFET switches 30 and 31 with a junction 33 connected to a capacitor 34 in a similar manner to that of FIG. 3. FIG. 5 does not show any gate drive circuit for the MOSFETs 30 and 31; this can be provided in the same manner as the gate drive circuit 32 of FIG. 3, or in any other desired manner. In the power supply arrangement of FIG. 5, the inductors 35 and 37 of the power converter shown in FIG. 3 are constituted by the leakage inductance and the magnetizing inductance, respectively, presented by a primary winding 50 of a transformer 51 connected between the capacitor 34 and ground. This provides the LLC topology of the power converter 20 in a particularly simple and convenient manner. However, the leakage and magnetizing inductances presented by the primary winding 50 of the transformer 51 can if desired be supplemented by additional inductances, coupled respectively in series and in parallel with the primary winding 50, in the manner shown in FIG. 3.

Alternatively, the power converter 20 need not be a resonant converter, the MOSFET switches 30 and 31 still forming a half-bridge the junction 33 of which is coupled via the capacitor 34 to the transformer winding 50, the capacitor 34 in this case having a relatively large capacitance and serving simply as a DC blocking capacitor. The power converter 20 can alternatively have any other desired form.

In the power supply arrangement of FIG. 5, a secondary winding 52 of the transformer 51 provides the AC output voltage on the AC supply line 22 for each CCFL 16 in the manner shown in FIG. 4. Each of one or more further secondary windings, represented by a secondary winding 53 in FIG. 5, provides a low voltage output of the power converter 20 to one or more rectifier and DC loads 54, for example for supplying power to the control unit 42 (shown in FIG. 4) and to other parts of apparatus, which may for example include a display device for which the CCFLs 16 provide a backlight. Feedback control (not shown in FIG. 5) to the power converter 20 may be provided from the secondary circuits 53, 54, instead of from a voltage sensor 44 responsive to the AC supply voltage Vac as shown in the power supply arrangement of FIG. 4. In this case the remainder of the arrangement of FIG. 5 still permits separate control of the average current of the, or each, CCFL 16.

FIG. 5 shows at its right side one CCFL 16, in series with its respective variable inductance unit 40 and current sensing resistor 18, coupled to the AC supply line 22. One or more (possibly a substantial number of) other CCFLs 16, each in series with its respective variable inductance unit 40 and current sensor, are not shown in FIG. 5 but can be similarly connected in parallel as indicated by dashed lines.

As shown in FIG. 5, the variable inductance unit 40 comprises a first inductor 55 in series with the CCFL 16, with a capacitor 56 in parallel with the inductor 55 to form a parallel resonant circuit. The capacitor 56 can be partly, or even entirely, constituted by capacitance of the inductor 55. A second inductor 57, for example having an inductance much smaller than that of the inductor 55, is loosely inductively coupled to the first inductor 55. A bidirectional or AC switch 58, protected by series-connected oppositely poled zener diodes 59 connected in parallel with it, is connected between the ends of the second inductor 57 and is controlled by a control signal CS supplied from the control unit 42.

A turns ratio of the inductors 55 and 57, for example of the order of 10:1 to 100:1, can be selected so that the AC switch 58 is subject only to relatively low voltages, despite the high voltages that are required for starting and operating the CCFL 16. This provides a substantial advantage, and also facilitates integration of the switch 58 into the control unit 42. By way of example the AC switch 58, represented in FIG. 5 by a simple switch for simplicity, can comprise two MOSFETs connected in series with opposite polarity, or a MOSFET that is coupled to the second inductor 57 via a diode bridge, or via a full wave rectifier with a center tapped inductor 57.

Alternatively, the inductors 55 and 57 could be replaced by a tapped inductor, with the switch 58 being connected in parallel with a tapped part of the overall inductor. However, in this case the AC switch 58 is not electrically isolated from the rest of the high voltage circuit including the CCFL 16, so that control of the AC switch 58 is more difficult, for example requiring the use of a high speed optical coupler. The electrical isolation of the switch 58 from the first inductor 55, provided as shown in FIG. 5, facilitates control of the AC switch 58.

The parallel resonant circuit formed by the first inductor 55 and the capacitor 56 is designed to have a resonant frequency, when the switch 58 is open, that is approximately the same as the frequency of the AC output of the power converter 20 on the AC supply line 22. For example, this may be of the order of 100 kHz. Consequently, with the switch 58 open this parallel resonant circuit provides a high impedance so that very little current flows via the CCFL 16. When the switch 58 is closed, the effective inductance of this parallel resonant circuit is reduced, for example by a factor of the order of 20, due to leakage inductance and the inductor 57. Consequently the parallel resonant circuit is tuned to a much higher resonant frequency, and presents a relatively low impedance at the frequency of the voltage Vac on the AC supply line 22, facilitating current flow to the CCFL 16. Controlling a duty cycle of the switch 58, as shown for its control signal CS in FIG. 5, thus controls an average current of the CCFL 16.

Although as described above the parallel circuit comprising the inductor 55 and the capacitor 56 has a high impedance at the AC supply frequency when the AC switch 58 is open and a low impedance at the AC supply frequency when the AC switch 58 is closed, alternatively a converse arrangement can be provided with this parallel circuit providing a high impedance at the AC supply frequency when the AC switch 58 is closed, and a low impedance at the AC supply frequency when the AC switch 58 is open.

As shown in FIG. 5, the current sensing resistor 18 drops a voltage dependent on the current of the CCFL 16 and supplies this to the control unit 42, which produces the control signal CS to maintain a desired average current of the CCFL 16. Any other desired form of sensing and feedback arrangement may alternatively be provided. For example, a voltage drop across the inductor 55, in either or both states of the switch 58, may instead be used to provide a feedback signal to the control unit 42. To this end for example the capacitor 56 can be formed by two series-connected capacitances forming a capacitive voltage divider to provide a feedback signal at a reduced voltage. Alternatively, a current transformer (not shown) can be provided for monitoring current flowing via the CCFL 16 and for providing a feedback signal to the control unit 42.

Figure 6:
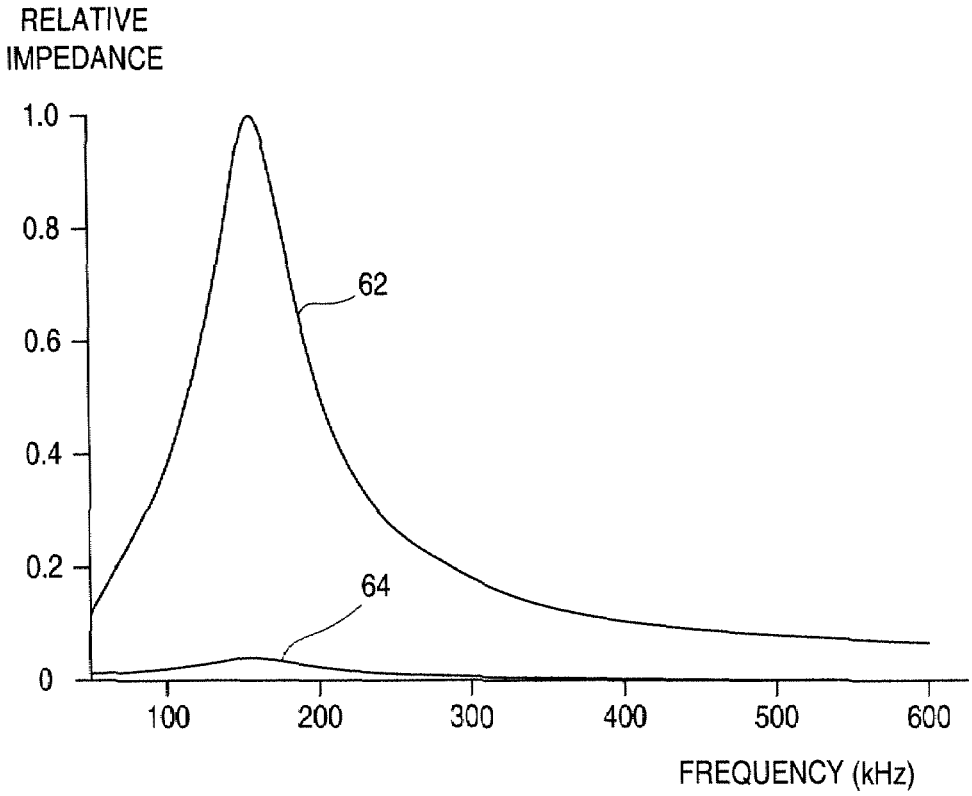
FIG. 6 is a graph illustrating as a function of frequency relative impedances of the variable inductance in the arrangement of FIG. 5.

By way of example, FIG. 6 illustrates, as a function of frequency, relative impedances of the variable inductance in the power supply arrangement of FIG. 5, as determined by simulation of one particular set of component values and characteristics. As shown in FIG. 6, a curve 62 represents the high impedance state with the switch 58 open. This curve has a peak at a frequency determined by the resonant circuit as discussed above, and the switching frequency of the power converter 20 can be selected to be at or near this peak. A curve 64 in FIG. 6 represents the low impedance state with the switch 58 closed.

Consequently, it can be seen that switching between the two impedance states of the variable inductance unit 22 with a controlled duty cycle of the switch 58 enables an average current of the CCFL 16 to be controlled by the control unit 42. The rate of this switching can be much lower than the switching frequency of the power converter 20.

Especially for driving a plurality of CCFLs 16, it is desirable for the power converter 20 to provide a relatively low output impedance. In the power supply arrangement of FIG. 6, this is facilitated by providing a capacitor 60 connected in parallel with the secondary winding of the transformer secondary winding 52, thereby providing a resonant circuit with a resonant frequency that is near but displaced from the AC supply frequency on the AC supply line 22. For example, for an AC supply frequency of 100 kHz, this resonant circuit may be tuned to a resonant frequency of the order of 80 kHz.

It will be appreciated that numerous parameters of the power supply arrangement, including the switching frequency of the power converter 20 and the characteristics of the transformer 50, inductors 55 and 57, and capacitors 56 and 60, can be selected and/or varied to provide particular desired characteristics of operation of the CCFLs 16. For example, in the case of an LLC power converter 20 which produces lower output voltage with increasing frequency, the switching frequency can be controlled to provide a desired output voltage from the secondary winding 52.

The operating characteristics of the power supply arrangement are also affected by parasitic elements, not shown, such as inductance and capacitance of the CCFL 16, which can also be taken into account in determining these operating characteristics.

Among the parameters affecting the operating characteristics of the power supply arrangement are the impedance of the CCFL 16, which is appreciably lower in the normal operation of the CCFL than in an initial state of the CCFL before ignition, or start of a discharge. The differing impedances can be used to advantage in association with the other impedance or resonance characteristics of the power supply arrangement to achieve a higher voltage applied to the CCFL 16 for starting a discharge than is applied to the CCFL 16 when it is in its normal operating state. Alternatively, a sufficient voltage for starting a discharge can be applied to the CCFL 16 even in its normal operating state, the average current of the CCFL 16 being limited by the feedback control arrangement including the control unit 42.

By way of example, the control unit 42 can provide a pulse density modulation control to provide a desired average current in the CCFL 16. To this end, the control unit 42 can provide a table of different duty cycle sequences for such modulation, with entries in the table being used sequentially to provide similar DC or low frequency components, providing the desired average current control, with different AC spectral contents for reducing or spreading electro-magnetic interference.

Figure 7:
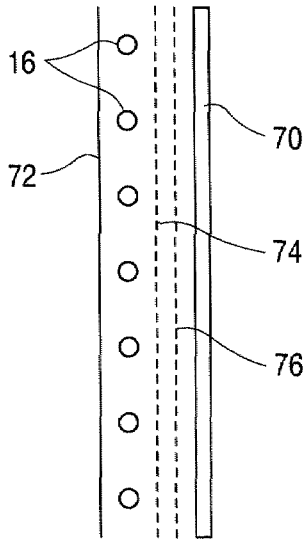
FIG. 7 PRIOR ART
FIG. 7 illustrates a backlight for a display device including a plurality of CCFLs.

For completeness, FIG. 7 diagrammatically illustrates a backlight for a display device including a plurality of CCFLs. As shown in FIG. 7, an array of CCFLs 16 is positioned behind a liquid crystal display (LCD) 70. A reflector screen 72 is positioned behind the CCFLs 16, and a diffuser 74 and polarization and colour filters 76 are positioned between the CCFLs 16 and the LCD 70, to provide a desired uniform back-lighting of the LCD 70 over its entire area, this being facilitated by individual control of average currents of the CCFLs 16 by the power supply arrangement as described above.

Although particular embodiments of the invention are described above, it should be appreciated that numerous changes, modifications, and variations can be made without departing from the scope of the invention as claimed.

For example, different types of inverter or power converter 20, other types and/or arrangements of the variable inductance unit 22, and sensing arrangements other than the current sensing resistors 18 may be provided. The control unit can alternatively provide open loop control of the variable inductance unit 22, instead of closed loop control dependent upon a sensed parameter as described above. Although the power supply arrangements described above relate to supplying power to a plurality of CCFLs, and are particularly advantageous for increasingly large numbers of CCFLs, they can also be applied to powering only a single CCFL, or to powering one or more other types of discharge tube or other types of load.

The invention claimed is:

1. A power supply arrangement comprising:

an AC (alternating current) supply line;

a variable inductance for connection in series with a cold cathode fluorescent lamp (CCFL) for supplying power from the AC supply line to the lamp;

a controller for controlling the variable inductance to control current of the lamp; and a current sensing element for providing to the controller a signal representing current of the CCFL, wherein the variable inductance comprises a first inductor for connection in series with the CCFL, a second inductor inductively coupled to the first inductor, and an AC switch coupled to the second inductor and controlled by the controller, wherein the second inductor and the AC switch are electrically isolated from the first inductor.

2. A power supply arrangement as claimed in claim 1 and including a capacitor coupled in parallel with the first inductor.

3. A power supply arrangement as claimed in claim 1 and including a capacitor coupled in parallel with the first inductor to form a resonant circuit which in one state of the AC switch has a resonant frequency at approximately a frequency of the AC on the AC supply line.

4. A power supply arrangement as claimed in claim 1 and including a switch mode power converter for supplying power to the AC supply line.

5. A power supply arrangement as claimed in claim 4 wherein the switch mode power converter includes a transformer having a secondary winding coupled to the AC supply line, the arrangement including a capacitor coupled in parallel with the secondary winding to form a resonant circuit with a resonant frequency near but displaced from a frequency of the AC on the AC supply line.

6. A power supply arrangement as claimed in claim 4 wherein the switch mode power converter includes a transformer having a secondary winding coupled to the AC supply line and at least one other secondary winding providing another output of the switch mode power converter.

7. A power supply arrangement as claimed in claim 1 for supplying power from the AC supply line to each of a plurality of CCFLs, the power supply arrangement comprising a plurality of variable inductances each for connection in series with a respective one of the CCFLs for supplying power thereto from the AC supply line, the controller being arranged to control each variable inductance to control current of the respective CCFL.

8. A power supply arrangement as claimed in claim 7 and including, for each of the plurality of CCFLs, a current sensing element for providing to the controller a signal representing current of the respective CCFL.

9. A power supply arrangement as claimed in claim 7 wherein each variable inductance comprises a first inductor for connection in series with the respective CCFL, a second inductor inductively coupled to and electrically isolated from the first inductor, and an AC switch coupled to the second inductor and controlled by the controller.

10. A power supply arrangement as claimed in claim 9 wherein each variable inductance includes a capacitor coupled in parallel with the first inductor.

11. A power supply arrangement as claimed in claim 9 and including a switch mode power converter for supplying power to the AC supply line, the power supply arrangement further including, for each variable inductance, a capacitor coupled in parallel with the respective first inductor to form a resonant circuit which in one state of the respective AC switch has a resonant frequency at approximately a frequency of the AC on the AC supply line.

12. A power supply arrangement comprising:

an AC (alternating current) supply line;

a plurality of variable inductances each for connection in series with a respective one of a plurality of cold cathode fluorescent lamps (CCFLs) for supplying power from the AC supply line to the lamps;

a controller for controlling the variable inductances to control currents of the lamps; and for each of the plurality of CCFLs, a current sensing element for providing to the controller a signal representing current of the respective CCFL, wherein each variable inductance comprises a first inductor for connection in series with the respective CCFL, a second inductor inductively coupled to and electrically isolated from the first inductor, and an AC switch coupled to the second inductor and controlled by the controller.

13. A backlight for a display device, the backlight comprising a plurality of CCFLs and a power supply arrangement as claimed in claim 12, each of the plurality of CCFLs being connected in series with a respective one of the variable inductances.

14. A power supply arrangement as claimed in claim 12 and including a switch mode power converter for supplying power to the AC supply line, the power supply arrangement further including, for each variable inductance, a capacitor coupled in parallel with the respective first inductor to form a resonant circuit which in one state of the respective AC switch has a resonant frequency at approximately a frequency of the AC on the AC supply line.

15. A backlight for a display device, the backlight comprising a plurality of CCFLs and a power supply arrangement as claimed in claim 14, each of the plurality of CCFLs being connected in series with a respective one of the variable inductances.

16. A method of providing power to a plurality of cold cathode fluorescent lamps (CCFLs), comprising the steps of:

producing an AC (alternating current) supply using a switch mode power converter;

coupling the AC supply to each of the CCFLs via a respective one of a plurality of variable inductances;

controlling each of the variable inductances to control current of the respective CCFL; and for each of the plurality of CCFLs, sensing current and providing to the controller a signal representing current of the respective CCFL, wherein each variable inductance comprises a first inductor coupled in series with the respective CCFL, a second inductor inductively coupled to and electrically isolated from the first inductor, and an AC switch coupled to the second inductor, and the step of controlling each of the variable inductances comprises opening and closing the respective AC switch with a controlled duty cycle.

17. A method as claimed in claim 16 and including the step of sensing current of the plurality of CCFLs, wherein the duty cycle of each AC switch is controlled in dependence upon the sensed current.

* * * * *